US009003687B2

(12) United States Patent
Cauley, Jr. et al.

(10) Patent No.: US 9,003,687 B2
(45) Date of Patent: Apr. 14, 2015

(54) FIREARM MAGAZINE LOADER

(71) Applicant: Battenfeld Technologies, Inc., Columbia, MO (US)

(72) Inventors: Dennis W. Cauley, Jr., Boonville, MO (US); Michael Poehlman, Columbia, MO (US); Adam J. Birk, Hallsville, MO (US); James Gianladis, Harrisburg, MO (US); Matthew Kinamore, Columbia, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 14/213,032

(22) Filed: Mar. 14, 2014

(65) Prior Publication Data

US 2014/0317985 A1 Oct. 30, 2014

Related U.S. Application Data

(60) Provisional application No. 61/784,489, filed on Mar. 14, 2013.

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83
USPC ..... 42/87, 88; 89/1.4; 86/47
See application file for complete search history.

(56) References Cited

U.S. PATENT DOCUMENTS 452,447 A 5/1891 Bruce
1,786,537 A * 12/1930 Holek ..... 86/47

(Continued)

FOREIGN PATENT DOCUMENTS

EP 0205661 A2 12/1986
GB 379179 8/1932

(Continued)

OTHER PUBLICATIONS

Amazon.com: ProMag RD USGI Magazine Loader, Black Polymer, http://www.amazon.com/ProMag-Magazine-Loader-Black-Polymer/dp/B002IWRFLK, 2 pages, admitted prior art [internet accessed Jul. 15, 2014].

(Continued)

*Primary Examiner* — Bret Hayes
(74) *Attorney, Agent, or Firm* — Senniger Powers LLP

(57) ABSTRACT

A firearm magazine loader. The magazine loader includes an ammunition holder adapted for receiving and holding ammunition from a tray in the same arrayed configuration in which the ammunition was held in the tray. The magazine loader includes a holder adapted for holding ammunition in an array including multiple columns and rows. The magazine loader includes a carrier and a biasing member biasing the carrier for movement. The magazine loader includes a movable carrier and a stop. The stop engages ammunition held in the carrier for indexing movement of the carrier. The magazine loader includes a plunger oriented for plunging ammunition from the carrier in a direction transverse to a direction of travel of the carrier. The magazine loader includes a slot sized and shaped for receiving a round of ammunition and configured for permitting the round of ammunition to slide along a length of the slot.

22 Claims, 15 Drawing Sheets

(56) References Cited

U.S. PATENT DOCUMENTS

| | | | | | |
|---|---|---|---|---|---|
| 1,840,477 | A | | 1/1932 | Von Frommer | |
| 2,191,130 | A | * | 2/1940 | Ludwig | 42/87 |
| 2,345,593 | A | * | 4/1944 | Garand | 86/47 |
| 2,783,570 | A | | 3/1957 | Kunz | |
| 4,538,371 | A | | 9/1985 | Howard | |
| 4,706,402 | A | * | 11/1987 | Csongor | 42/87 |
| 4,707,941 | A | * | 11/1987 | Eastman | 42/50 |
| 4,739,572 | A | * | 4/1988 | Brandenburg | 42/87 |
| 4,879,829 | A | | 11/1989 | Miller et al. | |
| 4,949,495 | A | * | 8/1990 | Mari | 42/87 |
| 4,970,820 | A | * | 11/1990 | Miller et al. | 42/87 |
| 5,301,449 | A | | 4/1994 | Jackson | |
| 6,754,987 | B1 | | 6/2004 | Cheng et al. | |
| 6,810,616 | B2 | | 11/2004 | Tal et al. | |
| 7,059,077 | B2 | | 6/2006 | Tal et al. | |
| 7,805,874 | B2 | | 10/2010 | Tal et al. | |
| 7,866,080 | B2 | | 1/2011 | Tucker | |
| 8,453,366 | B2 | | 6/2013 | Gray | |
| 8,484,874 | B2 | | 7/2013 | Kim | |
| 2012/0192477 | A1 | | 8/2012 | Kim | |
| 2012/0222343 | A1 | | 9/2012 | Kim | |
| 2013/0067788 | A1 | * | 3/2013 | Gray | 42/88 |
| 2014/0033592 | A1 | | 2/2014 | Fiorucci | |

FOREIGN PATENT DOCUMENTS

| | | | |
|---|---|---|---|
| KR | 102011011338 | A | 10/2011 |
| WO | 8503119 | | 7/1985 |

OTHER PUBLICATIONS

McFadden Machine Company Incorporated Clip Loader, The Ultimate Clip Loader, http://www.mcfaden.com/cliploader.html, 3 pages, admitted prior art [internet accessed Jul. 15, 2014].

Youtube, 3pointi.com Box-to-Mag Loader, 3 screenshots of video, https://www.youtube.com/watch?v=2m1rYDpiQlw, 1 page, video uploaded Jun. 21, 2011.

Three Point Innovation's Box-to-Mag AR-15 Speed Loader—The Firearm Blog, http://www.thefirearmblog.com/blog/2011/06/30/three-point-innovations-box-to-mag-ar-15-speed-loader/, 2 pages, posted Jun. 30, 2011.

International Search Report in related application PCT/US2014/027953 dated Jul. 18, 2014, 3 pages.

Written Opinion in related application PCT/US2014/027953 dated Jul. 18, 2014, 16 pages.

Office action in related U.S. Appl. No. 14/329,677, dated Oct. 23, 2014, 5 pages.

* cited by examiner

FIREARM MAGAZINE LOADER

CROSS-REFERENCE TO RELATED APPLICATION

This application claims priority to U.S. Provisional Patent Application No. 61/784,489, filed Mar. 14, 2013, which is hereby incorporated by reference in its entirety.

FIELD OF THE INVENTION

The present disclosure generally relates to a loader for loading ammunition, and more particularly to a loader for loading ammunition into a magazine for a firearm.

BACKGROUND OF THE INVENTION

Various types of firearms including rifles and handguns are configured to receive a magazine for feeding rounds of ammunition to a firing mechanism of the firearm. There are many types of firearm magazines, some of which are adapted to hold only a few rounds of ammunition, and others of which are adapted to hold tens to hundreds of rounds of ammunition. Loading ammunition into a magazine is conventionally performed by grabbing rounds by hand one at a time and positioning them individually into the magazine. This process can be time consuming, depending on the type and size of the magazine. In addition, this process can be tedious and cause hand fatigue.

There are various types of loaders which may be used to assist in loading ammunition into a magazine. In one example, the loader includes a hopper into which the ammunition is dumped in an unorganized fashion before it is loaded into the magazine. In another example, rounds of ammunition are laid on their side in side-to-side relationship in a bed before being loaded into the magazine. Although existing loaders are an improvement over loading a magazine by hand, additional improvements are needed.

SUMMARY

In one aspect of the present invention a firearm magazine loader is for loading ammunition including at least one round of ammunition into a firearm magazine. The firearm magazine loader includes a main body having a magazine receiver configured to receive the firearm magazine to be loaded with ammunition. The firearm magazine loader includes a carrier configured for carrying ammunition to be loaded into the firearm magazine. The carrier is sized and shaped to be supported by the main body for movement with respect to the main body. The carrier includes a holder including multiple slots constructed to support the ammunition in a generally vertical orientation and define a vertical position of the ammunition in the holder with respect to the carrier. The holder includes a front, a rear, a top, a bottom, and opposite sides. The slots extend between the opposite sides of the holder. Each slot is sized for receiving more than one round of ammunition between the opposite sides of the holder. The holder is constructed for receiving ammunition into the slots from the top of the holder. The firearm magazine loader includes a plunger supported by the main body configured for plunging ammunition from the holder into the magazine receiver. The plunger is reciprocally movable with respect to the main body between retracted and plunged positions to thrust ammunition from the holder into the magazine receiver.

In another aspect of the present invention an ammunition carrier is for use with a firearm magazine loader for loading ammunition into a firearm magazine. The ammunition includes at least one round of ammunition including a bullet end, a neck, a shoulder, a primer end, and a generally cylindrical body between the shoulder and primer end. The ammunition carrier includes a holder for supporting ammunition to be loaded into the firearm magazine, the holder has a front, a rear, a top, a bottom, opposite sides, and at least one slot extending between the opposite sides. The holder is constructed for receiving ammunition into the at least one slot from the top of the holder. The at least one slot is sized for holding multiple rounds of ammunition between the opposite sides and has opposite open ends on the opposite sides configured to permit ammunition supported in the at least one slot to be plunged out of one of the open ends. The at least one slot includes a front wall and a rear wall defining the at least one slot therebetween. The front and rear walls include shoulders projecting into the at least one slot constructed to engage the shoulder of a round of ammunition.

In still another aspect of the present invention a firearm magazine loader is for loading ammunition including at least one round of ammunition into a firearm magazine. The firearm magazine loader includes a main body including a magazine receiver configured to receive the firearm magazine to be loaded with ammunition, and includes a carrier configured for supporting ammunition to be loaded into the firearm magazine. The carrier is sized and shaped to be supported by the main body for movement with respect to the main body. The carrier includes a holder including a front, a rear, a top, a bottom, and opposite sides. The holder includes multiple slots positioned between the front and rear of the holder each sized for receiving more than one round of ammunition. The slots extend between the opposite sides of the holder. The holder is constructed for receiving ammunition in the slots from the top of the holder. The firearm magazine loader includes a plunger supported by the main body configured for plunging ammunition from the holder into the magazine receiver. The plunger is reciprocally movable with respect to the main body along a plunging axis between retracted and plunged positions to thrust ammunition from the holder into the magazine receiver. The carrier has a loading position with respect to the main body in which the carrier is supported by the main body and positioned for loading ammunition into the multiple slots of the holder from the top of the holder. The front of the holder is positioned rearward from the plunging axis when the carrier is in the loading position.

Other objects and features of the present invention will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
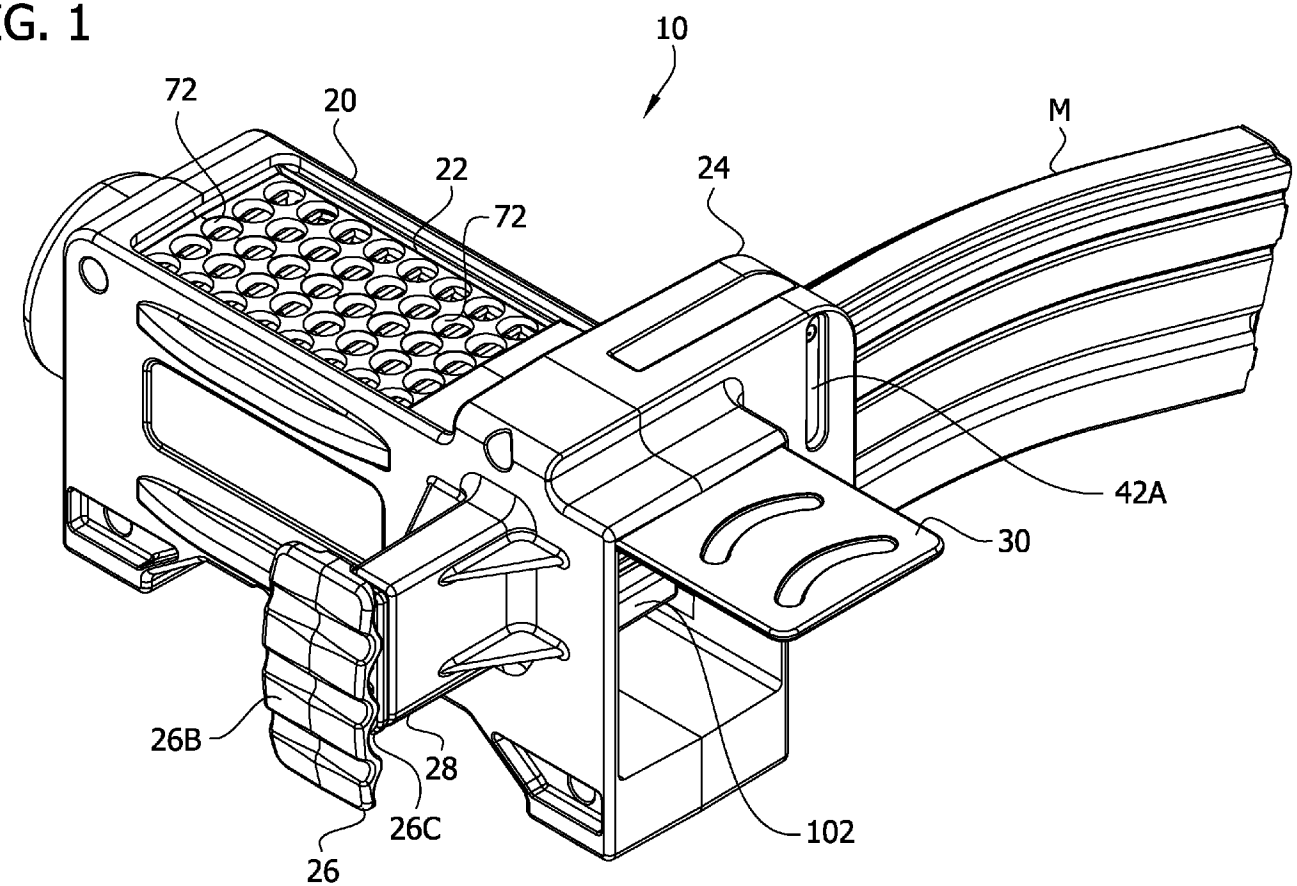
FIG. 1 is a front perspective of a magazine loader according to the present invention, a magazine being shown mounted on the magazine loader, and a door of the magazine loader being shown in an open position.

Referring to FIG. 1, a firearm magazine loader according to the present invention is designated generally by the reference number 10. As will become apparent, the loader 10 is adapted for loading several rounds of ammunition into a firearm magazine M in a relatively short time period. The loader 10 is configured for reducing hand fatigue associated with loading the magazine M. In some methods of using the loader 10, touching the ammunition by hand may not be necessary. The ammunition may be transferred directly from retail packaging or other storage containers into the loader 10 and then loaded into the magazine M by operating the loader.

Figure 2:
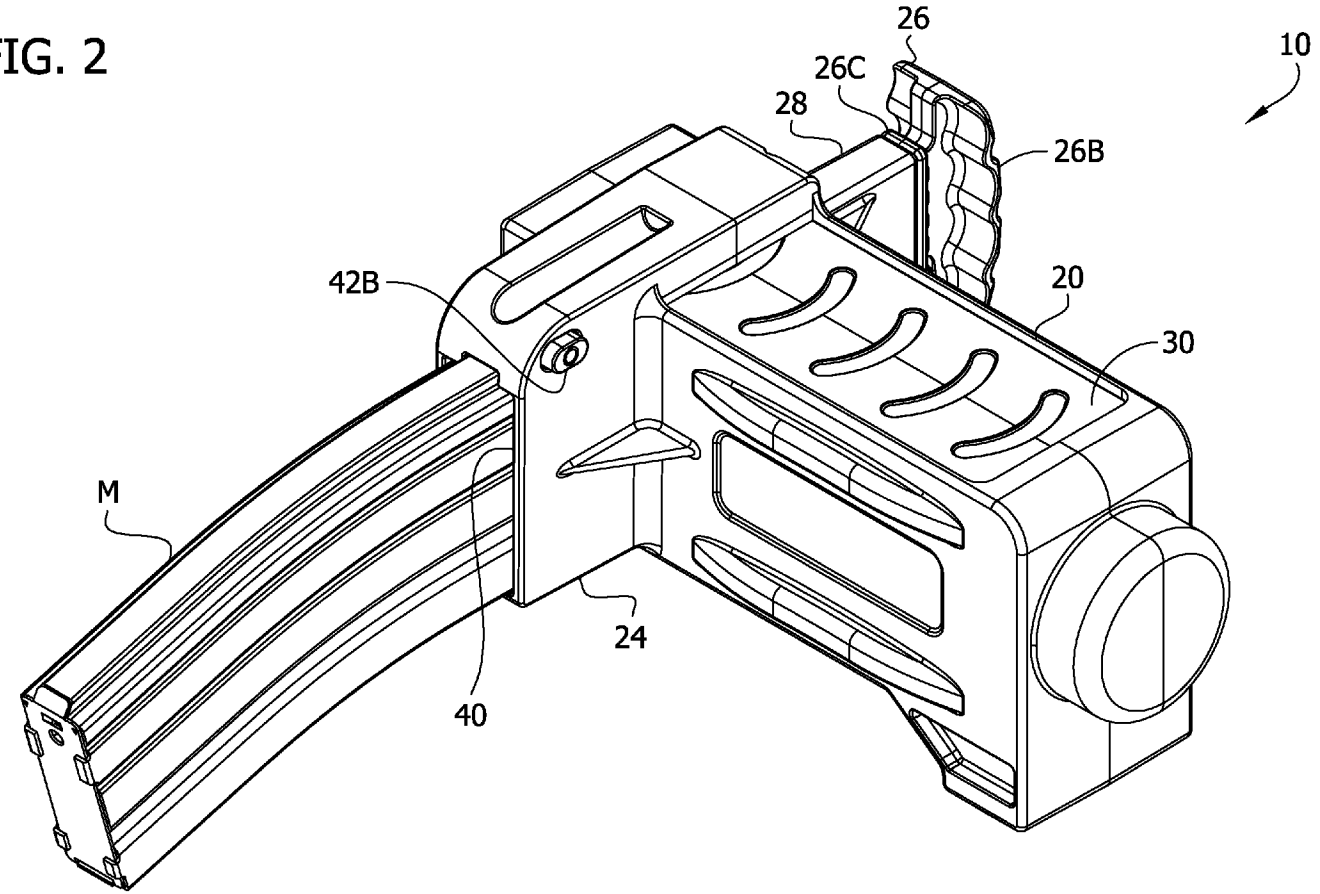
FIG. 2 is a rear perspective of the magazine loader and magazine of FIG. 1, the door being shown in a closed position.

As shown in FIGS. 1 and 2, the loader 10 generally includes a main body 20, an ammunition carrier 22 inside the main body, a magazine receiver 24 for holding a magazine M to be loaded, an ammunition plunger 26, and a plunger guide 28 in which the plunger is selectively movable. As will become apparent, ammunition is held in the ammunition carrier 22, the carrier travels inside the main body 20 to position the ammunition for loading into the magazine M, and the plunger 26 is selectively movable in a reciprocating fashion to thrust ammunition from the carrier 22 into the magazine.

The main body 20 has a generally rectangular shape and a hollow interior defining a track for guiding movement of the ammunition carrier 22 inside the main body. The main body 20 includes an open top selectively closeable by a sliding door 30. The door 30 has an open position (FIG. 1) and a closed position (FIG. 2). The door 30 may be opened for loading ammunition into the carrier 22 and closed for loading the ammunition from the carrier into the magazine M. The main body 20 has a closed rear end and an open front end. A spring 32 (broadly "biasing member") (FIGS. 3 and 7) is positioned inside the main body 20 in a cylindrical cavity defined by the rear wall behind the carrier 22. As explained in further detail below, the spring 32 applies a force on the carrier 22 biasing it toward the open front end of the main body. Other types of springs or other biasing members may be used without departing from the scope of the present invention.

The magazine receiver 24 includes an arm extending laterally with respect to the main body 20 near the front end of the main body. The magazine receiver 24 includes a channel 40 having an open end opening into the interior of the main body 20 and an opposite open end adapted for receiving the magazine M in the channel. The channel 40 has a generally rectangular cross section corresponding closely to the generally rectangular cross section of the magazine M. The channel 40 defines a socket for receiving the loading end of the magazine M and securing it in position for receiving ammunition from the carrier 22. The magazine receiver 24 includes a retainer for securing the magazine M in the channel 40. The retainer includes a catch 42A (FIG. 1) positioned on a front side of the magazine receiver 24 which extends into the channel 40 for engaging an opening on the magazine. The catch 42A secures the magazine M in the channel 40 much like the magazine M would be secured in a receiver 24 of a firearm. The retainer includes an actuator or button 42B (FIG. 2) on the opposite side of the magazine receiver 24 which may be pushed to disengage the catch 42A from the magazine M for permitting it to be removed from the receiver. A spring (not shown) inside the receiver 24 biases the catch 42A toward a magazine engaging position. Pressing the button 42B overcomes the biasing force of the spring 42C for disengaging the catch 42A from the magazine M.

In FIGS. 1 and 2, a magazine M for an AR-15 rifle is shown mounted in the magazine receiver 24. The magazine M is configured for holding ammunition such as .223 caliber rounds. It will be understood that the AR-15 magazine M is illustrated by example without limitation and that other types and configurations of magazines (e.g., configured for holding other caliber ammunition) may be used without departing from the scope of the present invention. For example, the basic features of the loader 10 may be maintained but changed in dimension etc. to adapt it for receiving other magazines and/or loading other sizes of ammunition.

The plunger guide 28 extends laterally with respect to the main body 20 opposite the magazine receiver 24. The plunger guide 28 includes a channel 50 (FIG. 3) having an open end opening into the interior of the main body 20 and an opposite open end adapted for receiving the plunger 26. The plunger 26 includes an elongate shaft 26A and a handle 26B. The sides of the shaft 26A include closed end channels which engage protrusions in the channel 50 to prevent the plunger 26 from being removed from the plunger guide 28. There may be a releasable shaft engaging member (e.g., a pin) provided in the plunger guide 28 for engaging a closed end slot for preventing complete removal of the shaft 26A from the guide except when the shaft engaging member is released or removed from the guide. In the illustrated embodiment, the plunger 26 is generally T-shaped. The shaft 26A has a distal end adapted for engaging the ammunition in the carrier 22 and pushing it into the magazine M. The shaft 26A has a generally rectangular cross section including a height which is less than the height of the ammunition to be loaded in the magazine M and a width which is about the same as or less than the width of the ammunition. As will become apparent, this sizing of the shaft 26A permits it to move through the carrier 22 for pushing the ammunition out of the carrier. The handle 26B is connected to the proximal end of the shaft 26A and is adapted for enhancing grip of a user for pulling the plunger 26 out of the interior of the main body and for pushing the plunger 26 back into the interior. The channel 50 of the plunger guide 28 has a generally rectangular cross section corresponding to the cross section of the plunger shaft 26A. The plunger 26 is shown in a fully plunged position in FIGS. 1 and 2. In this position, a stop 26C on the plunger shaft 26A in the form of a circumferential flange engages the end of plunger guide 28 to prevent further movement of the plunger into the main body 20. The plunger shaft 26A includes a longitudinal or plunging axis which extends toward the magazine receiver 24 when the plunger 26 is received in the plunger guide 28 and which extends through the main body 20 to adjacent the magazine receiver when in its fully plunged position. As explained in further detail below, in use, the plunger 26 may be actuated in a reciprocating fashion by a user by pulling the distal end of the plunger out of the main body 20 (e.g., so the distal end is positioned in the plunger guide 28) and pushing the distal end of the plunger back into the main body. Pushing the plunger 26 into the main body 20 thrusts ammunition from the carrier 22 into the magazine M mounted on the magazine receiver 24.

Figure 3:
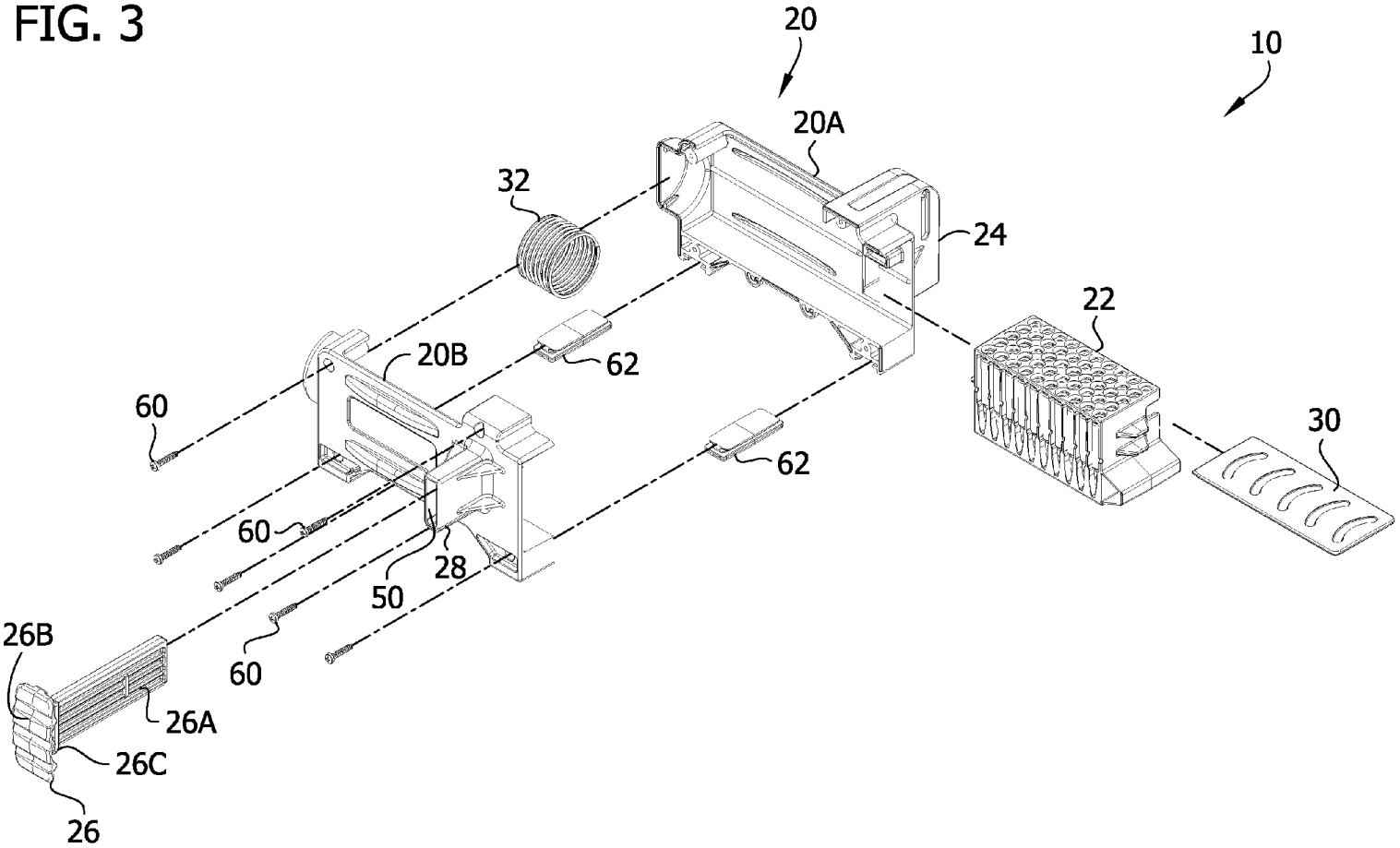
FIG. 3 is an exploded perspective of the magazine loader.

As shown in FIG. 3, in the illustrated embodiment, the main body 20 is formed by two shell-like pieces 20A, 20B secured together by fasteners 60 (e.g., screws). The plunger guide 28 and the magazine receiver 24 are formed simultaneously with portions of the main body 20 as part of respective shell pieces 20A, 20B. For example, the pieces 20A, 20B may be formed of injection molded plastic. Bridge members 62 are provided for strengthening the connection of the pieces 20A, 20B to each other. In manufacture, the spring 32 and carrier 22 may be positioned between the shell-like pieces 20A, 20B before they are secured together to capture the spring and carrier in the interior of the main body 20. The spring 32 may be made of metal or any other suitable material. The plunger 26, carrier 22, and door 30 may be formed of injection molded plastic. Other suitable materials for the parts described herein may be used without departing from the scope of the present invention.

Figure 4:
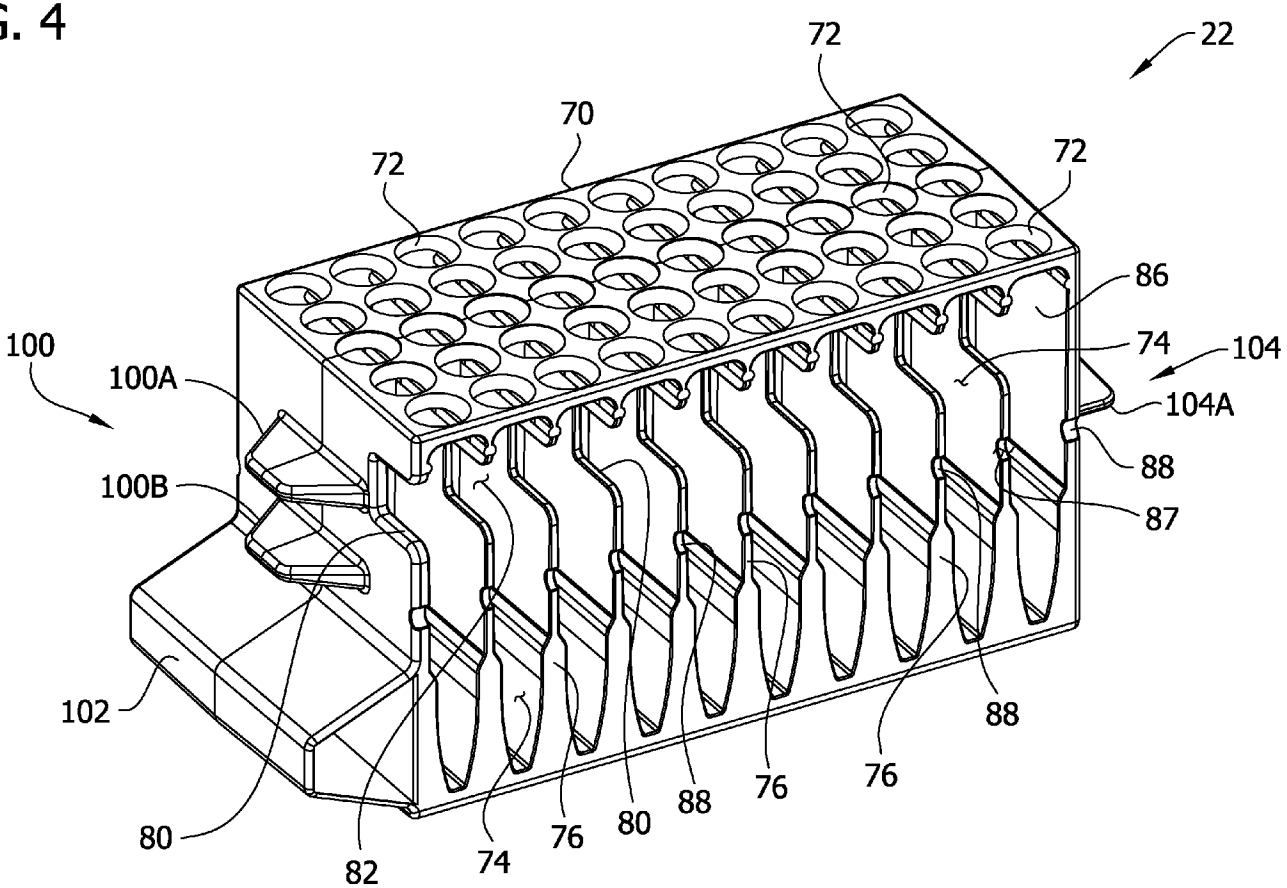
FIG. 4 is a perspective of an ammunition carrier of the magazine loader.

Referring to FIG. 4, the carrier 22 includes a holder 70 adapted for holding a plurality of rounds of ammunition standing in an array including multiple columns and rows. The holder 70 includes a front end and a rear end (to the left and right, respectively, in FIG. 4). The holder 70 includes top, bottom, left, and right sides and a longitudinal axis extending between the front and rear ends. The longitudinal axis may also be referred to as the travel axis of the carrier. The carrier 22 travels along this axis inside the main body 20. The top wall of the holder 70 includes circular openings 72 sized for receiving individual rounds of ammunition in an array of multiple columns and rows. In the illustrated embodiment, the array of openings 72 includes five columns extending between the right side of the holder 70 and the left side of the holder (into the page in FIG. 4) and ten rows extending between the front and rear ends of the holder (from left to right in FIG. 4), for a total of fifty openings. Below the top wall, the holder 70 includes a plurality of slots 74 in register with and corresponding to the rows of openings 72 in the top wall. The slots 74 extend transversely with respect to the travel axis. The slots 74 are defined by upstanding partitions 76 which extend between the sides of the holder 70 and which are spaced from one another between the front and rear ends of the holder. The slots 74 open out of the opposite left and right sides of the holder 70 for permitting the plunger 26 to enter the slots from one side and push the ammunition out the other side.

The front end of the holder 70 and each of the partitions 76 includes a notch 80 adjacent their upper right sides. The notches 80 are positioned in register with each other along the length of the holder 70 for defining a channel 82 (FIGS. 4 and 6) in the holder extending generally parallel to the travel axis of the holder. The channel 82 is adapted for receiving a stop 84 (FIG. 8) for permitting it to engage ammunition in the holder 70 for indexing movement of the holder with respect to the plunger 26 and magazine receiver 24, as described in further detail below. It will be appreciated that the rear end of the holder 70 does not include such a notch 80 and defines a stop engaging surface 86 at the rear end of the channel 82 for preventing movement of the holder 70 beyond a certain position, as will become apparent. However, the rear end of the holder may include a notch (not shown) such that the channel 82 extends the full length of the holder without departing from the scope of the present invention. In that event, the holder 22 may extend as far out of the main body 20 as permitted by the spring 32.

Figure 8:
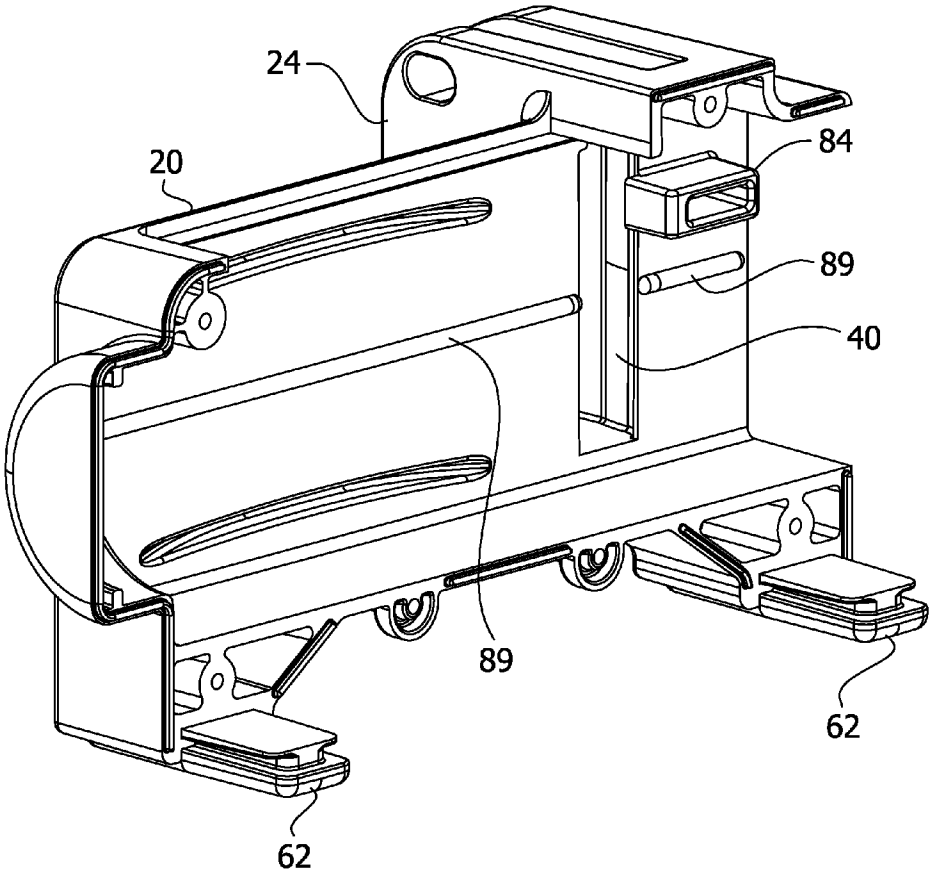
FIG. 8 is a view similar to FIG. 7 but having the spring and ammunition carrier removed to expose a stop for indexing movement of the ammunition carrier.

The carrier 22 includes channels 87 extending along the length of the carrier on opposite sides of the carrier. Only one of the channels 87 is shown in FIG. 4. It will be understood that there is a similar channel 87 on the opposite side of the carrier 22. The channels 87 are defined by relatively small notches 88 in the front and rear ends of the carrier 22 and in each of the partitions 76. The channels 87 are adapted for receiving and gliding along respective slide rails 89 protruding inward from the interior surface of the main body 20. One such slide rail 89 is shown in FIG. 8 for engaging the channel 87 on the left side of the carrier 22. It will be understood that a similar slide rail 89 is provided on the opposite side of the interior of the main body 20 corresponding to channel 87 on the other side of the carrier 22.

Figure 5:
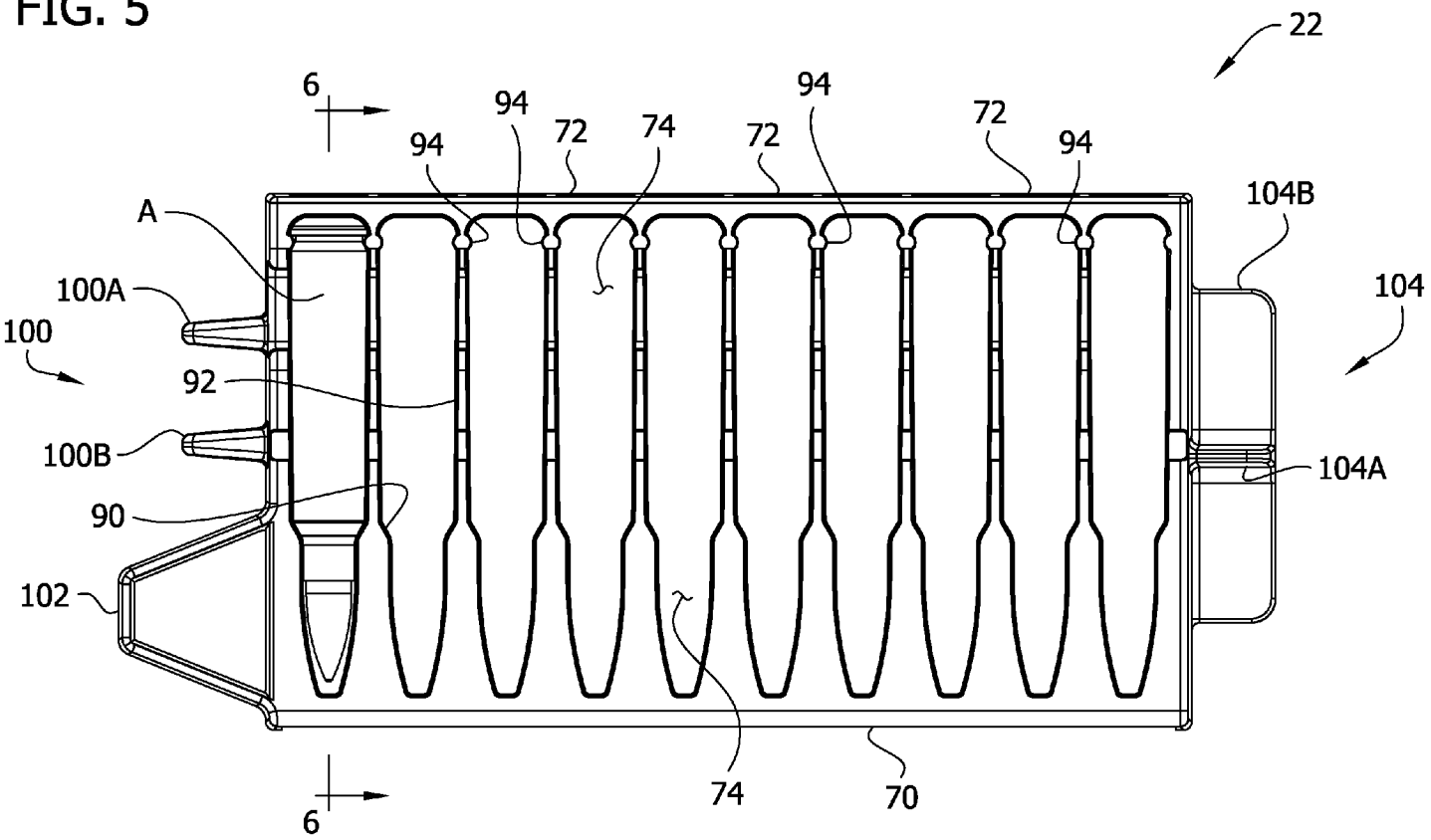
FIG. 5 is a side elevation of the ammunition carrier.
Figure 6:
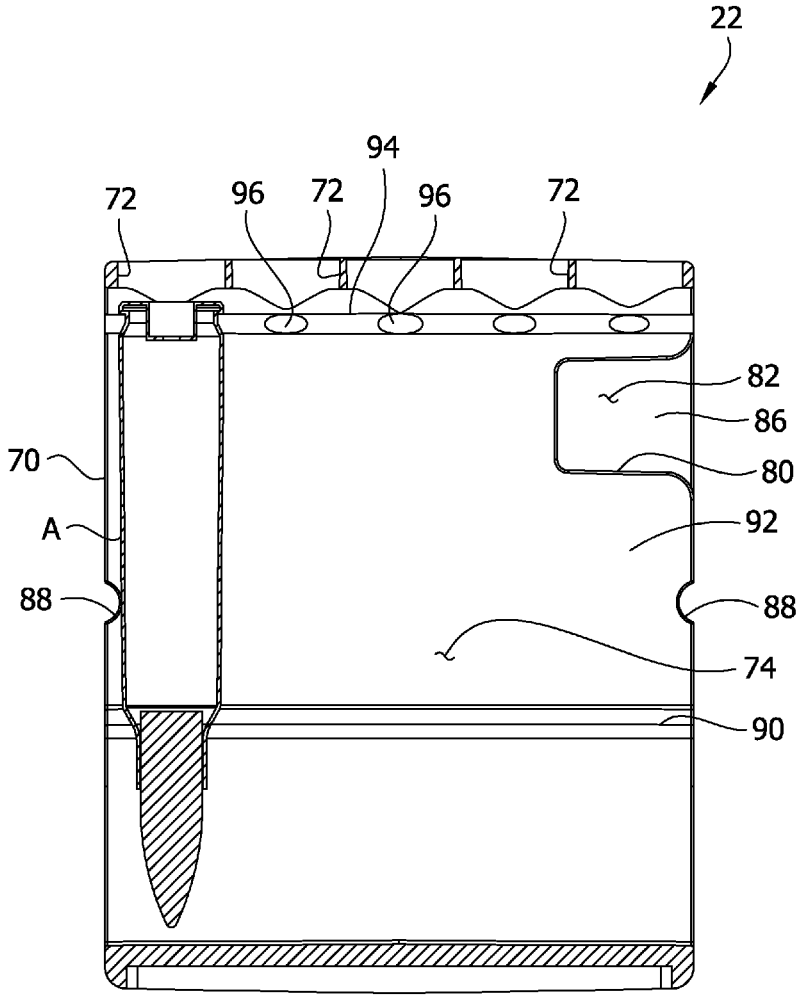
FIG. 6 is a section of the ammunition carrier taken in the plane including the line 6-6 in FIG. 5.

Referring to FIG. 5, the partitions 76 are shaped to provide the slots 74 with profiles configured for supporting rounds of ammunition in an upright position, bullet end down, and also for permitting sliding movement of the rounds of ammunition along the slots when pushed by the plunger 26 toward the magazine receiver 24. The slots 74 have cross-sectional shapes closely approximating the shape of a round of ammunition to be held in the holder 70. The holder 70 is adapted for holding non-belted .223 caliber centerfire rounds. The holder 70 may be adapted for holding other sizes and types of rounds without departing from the scope of the present invention. A single round of ammunition A is shown in the first row or slot 74 of the holder 70 in FIG. 5 to demonstrate the fit of the round in the slot 74. The round includes a casing and a bullet. The casing includes a relatively narrow generally cylindrical neck, a wider generally cylindrical body which is longer than the neck, and a shoulder between the neck and body which tapers outward from the neck to the body. A bullet seated in the neck provides the round with a generally pointed front end. At the rear end of the round, the casing includes a flange and a circumferential groove between the flange and the body. Unlike a rimfire or rimmed round of ammunition, the rear flange of the casing does not extend outboard of the cylindrical body of the casing. The cross section of each slot 74 includes a generally narrow and pointed lower end corresponding to the relatively narrow width of the neck and bullet and pointed end of the bullet. Each slot 74 includes an outwardly tapered shoulder 90 adapted for engaging the shoulder of the casing in generally flush engagement. An intermediate portion 92 of the cross section of each slot 74 includes generally parallel walls to define a space corresponding closely to the width of the cylindrical body of the casing. At an upper end of each slot 74, slide rails 94 are provided on opposite sides. The slide rails 94 are sized and positioned for engaging the casing in the circumferential groove adjacent its tail end when the shoulder of the casing is in engagement with the shoulder 90 of the slot 74. A slide rail 94 is shown in closer detail in the cross-sectional view of FIG. 6. The slide rails 94 are adapted for engaging the groove or flange to maintain the round of ammunition in an upright position in the slot 74. Additional rounds of ammunition positioned to the sides of a round of ammunition in the same slot 74 are not needed to prevent the round of ammunition from "falling over" in the slot. As shown in FIG. 6, each slide rail 94 includes a series of spaced apart notches 96 positioned in register with and corresponding to the circular openings 72 in the top wall of the holder 70. The notches 96 are rounded to correspond to the cylindrical side walls of the main bodies of the casing. The notches 96 permit the cylindrical body of the casings to pass the slide rails 94 when rounds are loaded into the holder 70 through the openings 72 in the top wall. The notches 96 are short enough such that rotation of a round of ammunition tending to cause it to "fall over" is prevented by engagement of the flange of the casing with the slide rail 94 adjacent opposite ends of the notches. Referring again to FIG. 5, the slide rails 94 are configured for permitting the grooves of the casings to slide along the rails. The flange of the casing is slidable in a space above the slide rails 94 and below the openings 72 of the top wall. Accordingly, the slide rails 94 are adapted for permitting the rounds of ammunition to slide in the slots 74 along the width of the holder 70 to permit the plunger 26 to push the ammunition toward the magazine receiver 24. Other configurations of slide rails may be provided, and the slide rails may be omitted, without departing from the scope of the present invention.

Figure 7:
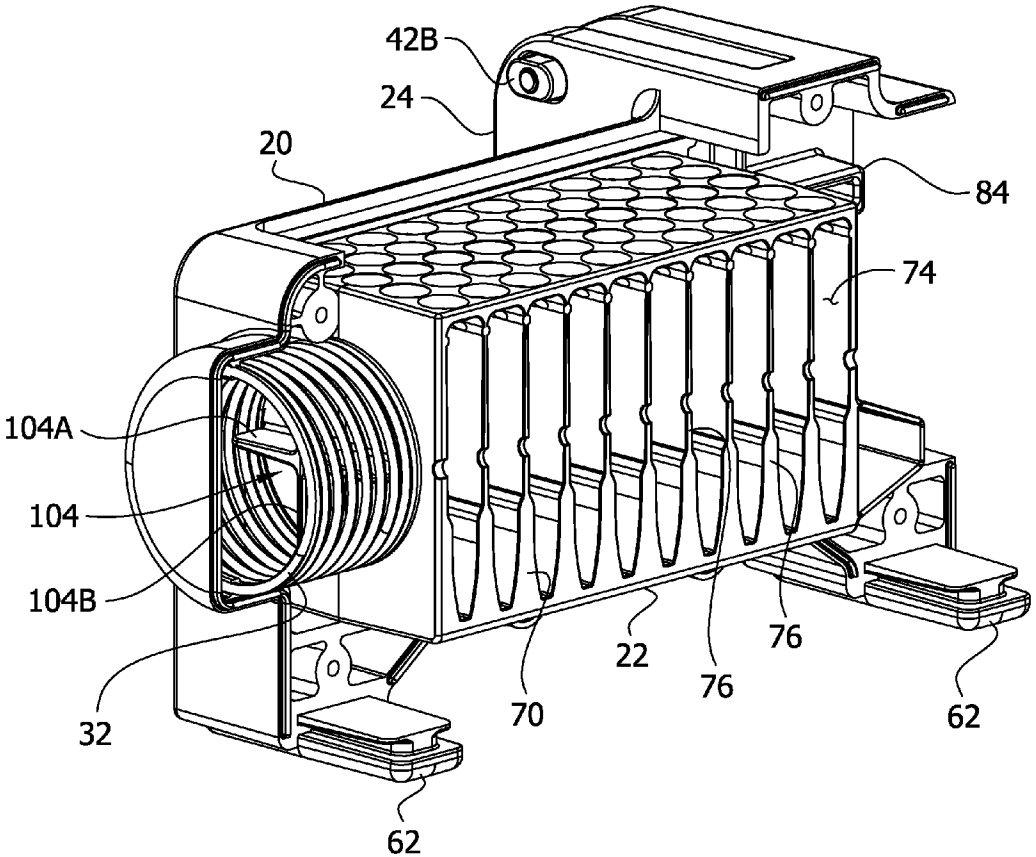
FIG. 7 is a rear perspective of the magazine loader in a partially disassembled state to expose a spring and the ammunition carrier inside a main body of the magazine loader.

Referring to FIGS. 4 and 5, the carrier 22 also includes a cam surface 100, a push member 102, and a biasing member engagement surface 104. The cam surface 100 is provided at the front end of the holder 70. In the illustrated embodiment, the cam surface 100 includes two cams 100A, 100B extending forward from the front end of the holder 70. The cams 100A, 100B include canted side surfaces for engagement by the distal end of the plunger 26 to facilitate positioning of the distal end of the plunger against the front of the carrier, as explained in further detail below. The push member 102 extends forward from the front end of the holder 70 and is adapted for receiving fingers of a user to push the carrier 22 rearward in the interior of the main body 20, as will be described in further detail below. In the illustrated embodiment, the biasing member engagement surface 104 includes protrusions 104A, 104B forming an X-shape extending rearward from the holder 70 for being engaged by the cylindrical compression spring 32. More specifically, the spring 32 has an inside diameter about the same as the height and width of the X-shape for receiving the end of the spring over the protrusions 104A, 104B and maintaining the end of the spring in position against the rear side of the carrier 22, as shown in FIG. 7. The cam surface 100, push member 102, biasing member 32, and/or biasing member engagement surface 104 may be omitted, or other configurations may be used, without departing from the scope of the present invention.

Referring to FIG. 8, the interior of the main body 20 includes a stop 84 protruding inward from an inner surface of the main body. The stop 84 is positioned immediately forward of the channel 40 of the magazine receiver 24. The stop 84 is sized and shaped for reception in the channel 82 of the holder 70 defined by the notches 80 in the right sides of the front end and partitions 76 (see FIGS. 4 and 6). As the carrier 22 moves under bias of the spring 32 from the rear end of the main body 20 toward the front end of the main body, the channel 82 slides over the stop 84. The stop 84 is positioned to engage rounds of ammunition in the first column of the holder 70. If a round of ammunition is present in any row of the holder 70 in the first column, it engages the stop 84 and stops movement of the carrier 22 at a position in which the row in which the round of ammunition is positioned is in register with the plunger 26 on one side and in register with the magazine receiver 24 on the opposite side. Accordingly, as will be explained in further detail below, the stop 84 indexes movement of the carrier 22 to position slots 74 which include ammunition in position for being plunged by the plunger 26 into the magazine M.

An example method of using the loader 10 is illustrated in FIGS. 9-15. Although the magazine M is not shown in FIGS. 9-15, it will be understood the magazine would be mounted on the magazine receiver 24 for receiving rounds of ammunition plunged by the plunger 26. Before ammunition can be loaded into the magazine M, the ammunition must be loaded into the carrier 22. The arrayed holding configuration of the carrier 22 provides it with a particular advantage over other loaders. For example, ammunition is commonly sold and/or stored in a tray in which the ammunition is held bullet end up in an array including multiple columns and rows, such as five columns and ten rows. The ammunition may be transferred in its arrayed configuration directly from the tray to the carrier 22. The carrier 22 receives the ammunition in the same arrayed configuration as it was previously held in the tray. More specifically, the points of the bullets may be positioned in register with the openings 72 of the top wall of the holder 70 and the rounds may then be dumped from their storage tray into the holder 70 without being touched by hand. This enables stored or retail packaged ammunition to be very rapidly loaded into the holder 70. An array of ammunition can be loaded into the holder 70 at the same time in a batch-like transfer. Alternatively, rounds of ammunition may be positioned one-at-a-time into the holder 70. Other ways of loading ammunition in the holder 70 may be used without departing from the scope of the present invention. Once positioned in the slots 74, the rounds of ammunition are prevented from "falling over" in the slots 74 as a result of the slide rails 94 described above.

Figure 9:
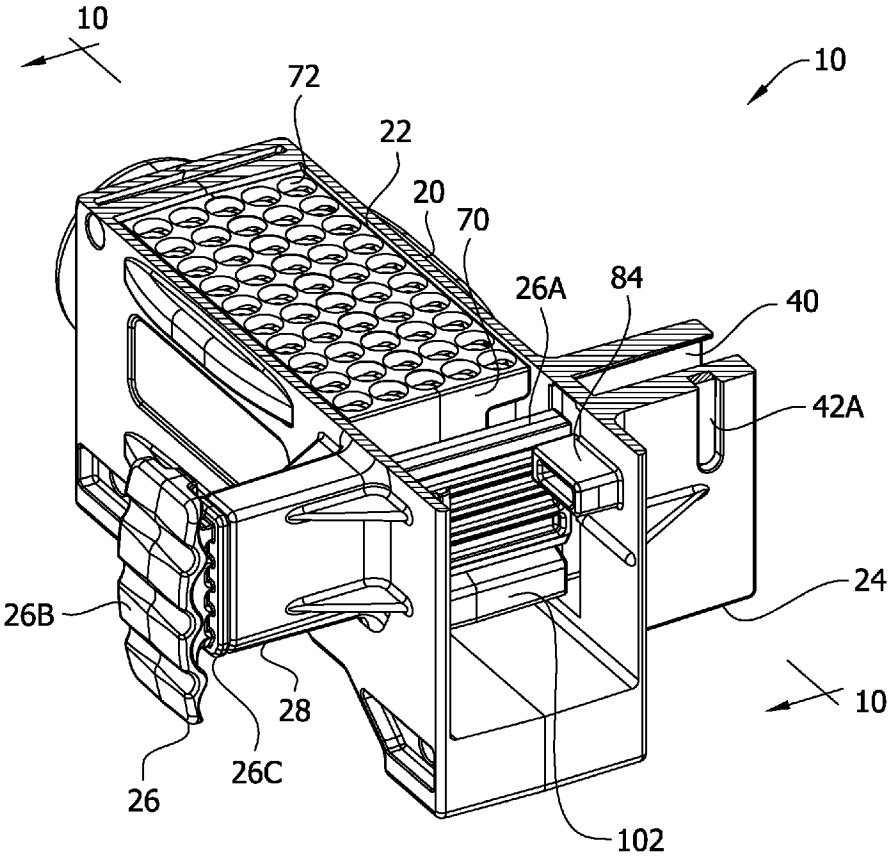
FIG. 9 is a front perspective of the loader having a top portion broken away to expose the interior of the loader, the loader being shown in a starting position with the ammunition carrier loaded with ammunition and a plunger in front of the ammunition carrier.
Figure 10:
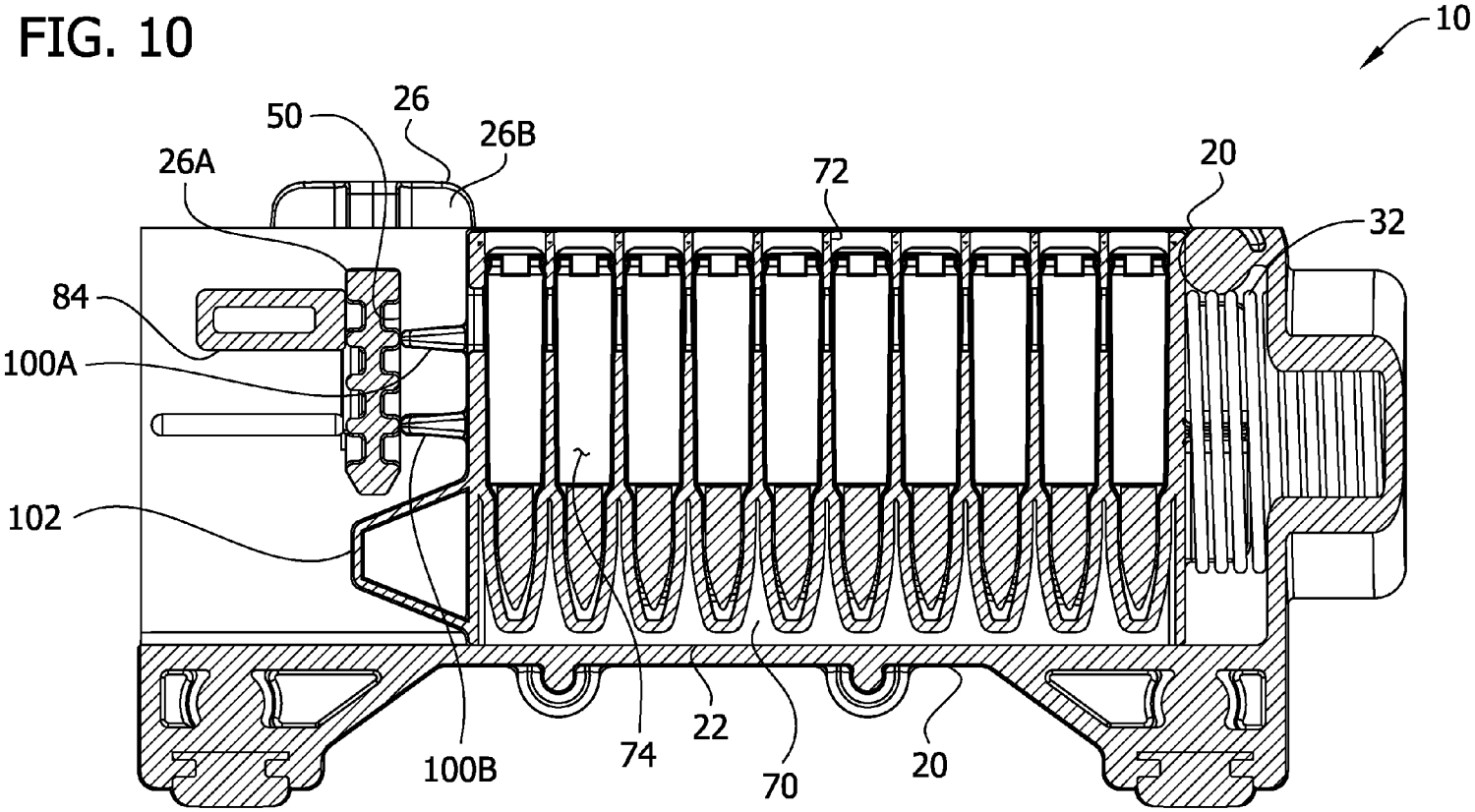
FIG. 10 is a section of the loader taken in the plane including line 10-10 indicated in FIG. 9.
Figure 11:
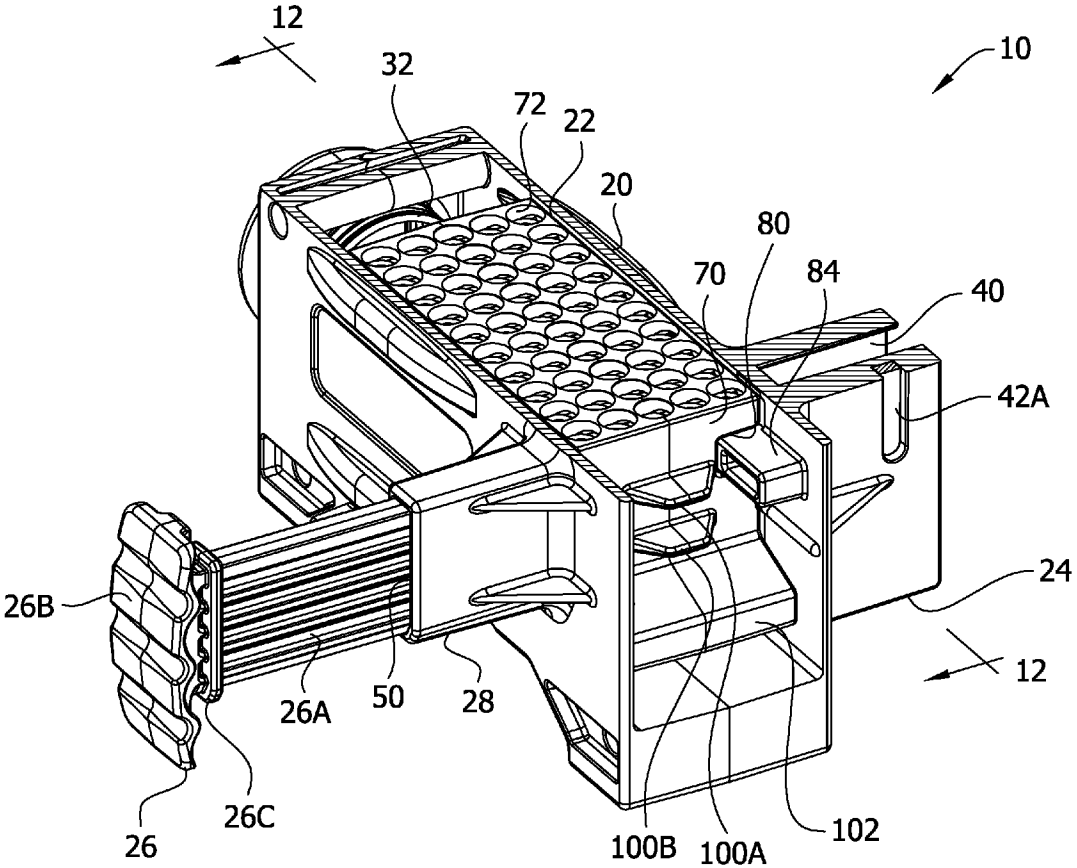
FIG. 11 is a front perspective of the loader having a top portion broken away to expose the interior of the loader, the plunger being shown in a retracted position, and the carrier being shown moved forward such that a round of ammunition in the first row of the carrier is in engagement with the stop.
Figure 12:
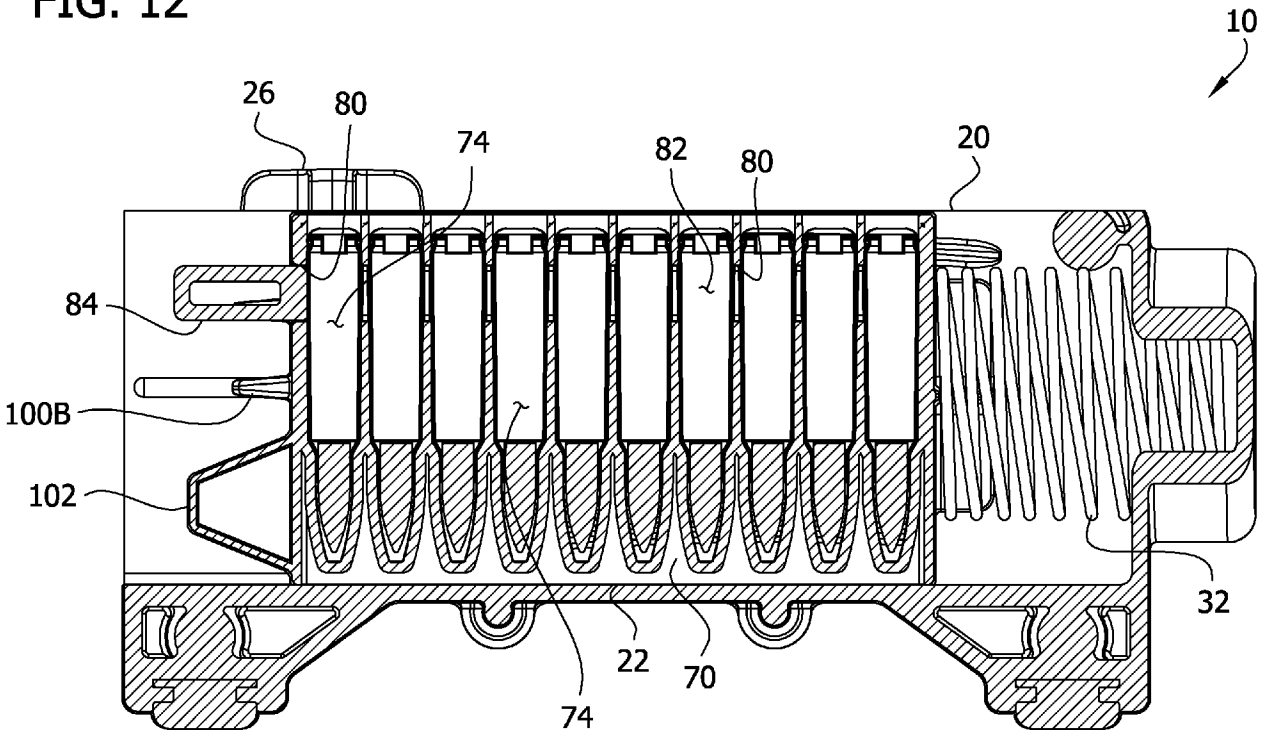
FIG. 12 is a section of the loader taken in the plane including line 12-12 indicated in FIG. 11.
Figure 13:
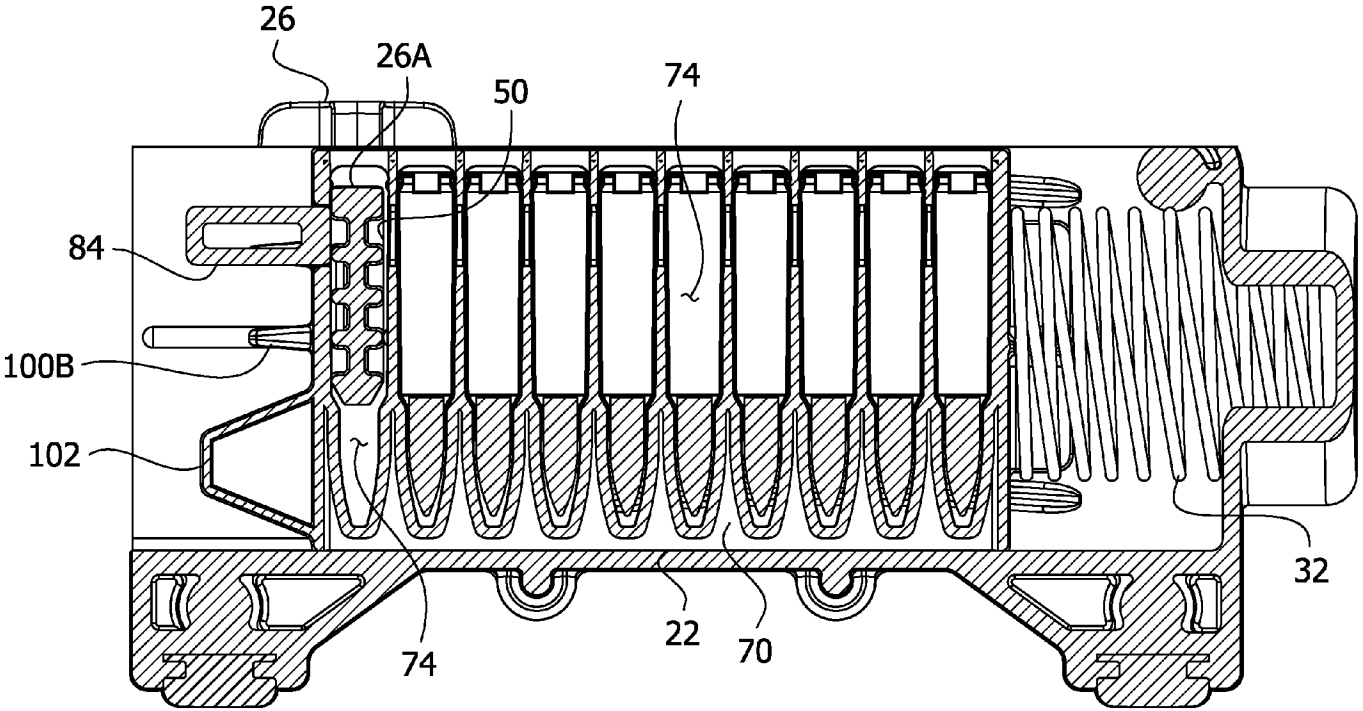
FIG. 13 is a view similar to FIG. 12 but showing the plunger having plunged the first row of ammunition out of the ammunition carrier.
Figure 14:
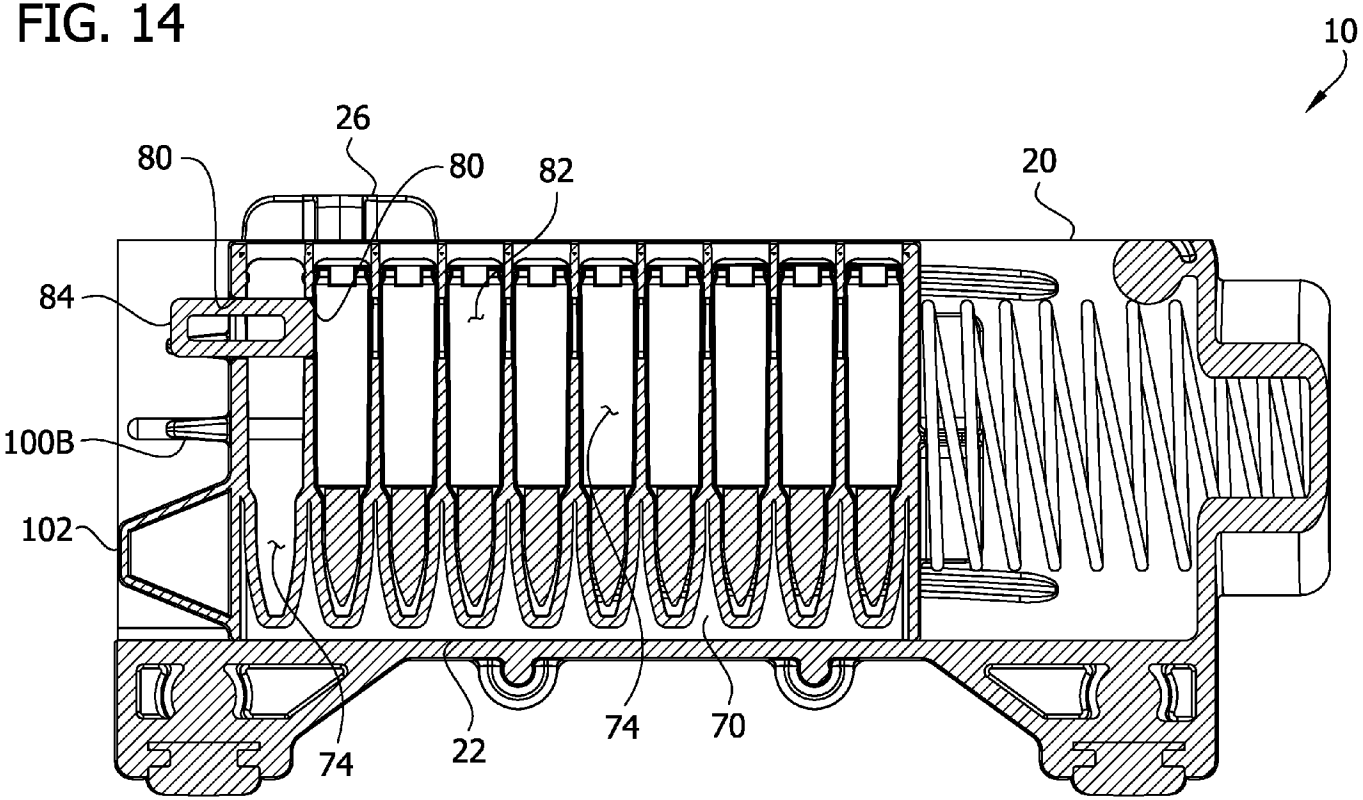
FIG. 14 is a view similar to FIG. 13 but showing the plunger having been retracted out of the ammunition carrier for permitting the carrier to move the second row of ammunition in register with the plunger for being plunged into the magazine.
Figure 15:
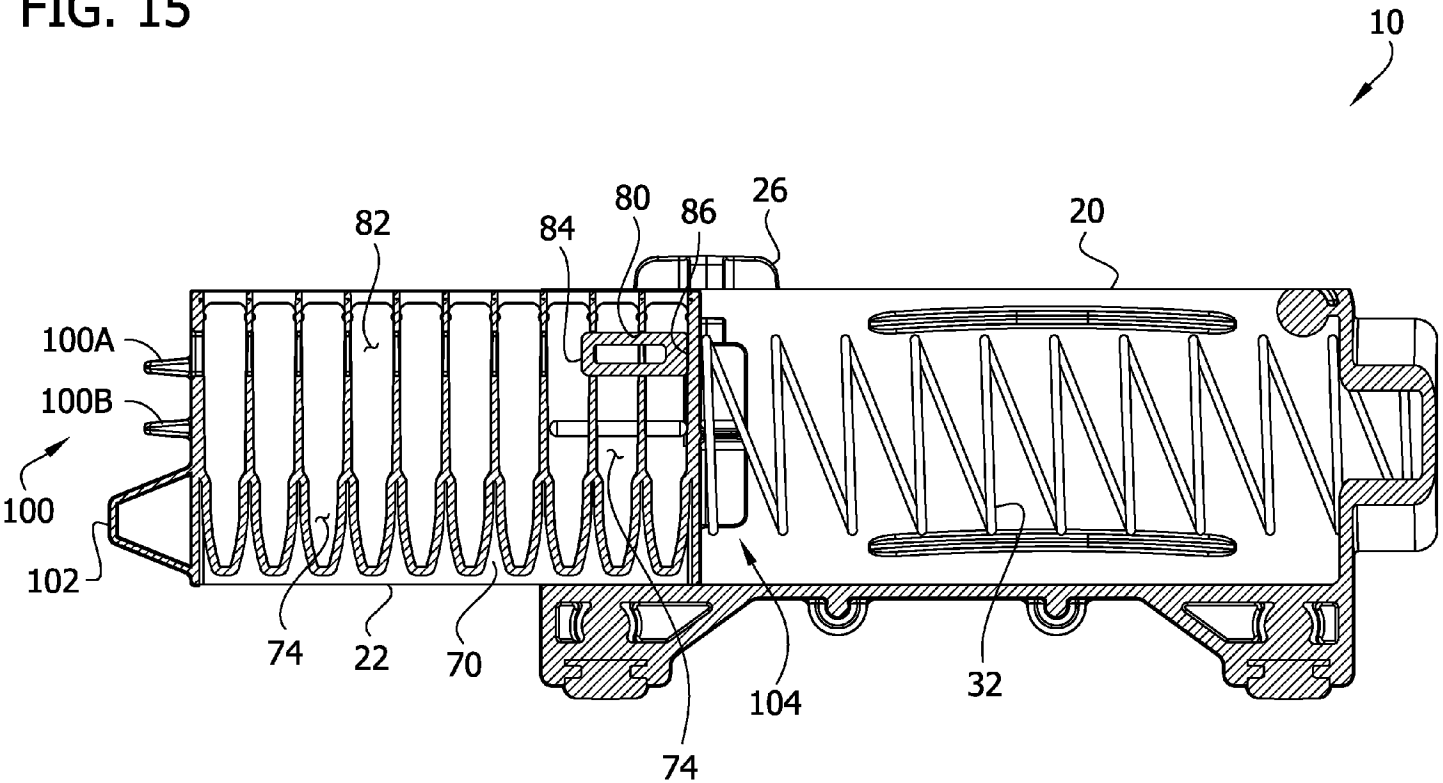
FIG. 15 is a view similar to FIG. 14 but on a smaller scale and showing all of the rows of the ammunition carrier emptied of ammunition and the stop in engagement with a stop engagement surface of the ammunition carrier.

FIGS. 9 and 10 illustrate the carrier 22 and plunger 26 in a starting position. The carrier 22 is fully loaded with ammunition. In the starting position, plunger 26 is between front end of carrier 22 and the stop 84. The plunger 26 engages the cams 100A, 100B on the front end of the carrier 22 and engages the rear side of the stop 84. The plunger 26 holds the carrier 22 in its rearward loading position (e.g., for loading through the slide door 30 as shown in FIG. 1). In this position, the spring 32 is compressed and the carrier 22 is in its fully retracted position. After the carrier 22 is loaded with ammunition, the distal end of the plunger 26 is pulled out of the interior of the main body 20 into the plunger guide 28. As shown in FIGS. 11 and 12, the biasing force of the spring 32 causes the carrier 22 to move forward along the interior of the main body 20. The forward movement of the carrier 22 is stopped when a round of ammunition positioned in the first row (the first slot 74) of the first column engages the stop 84. In this position, the first row of the holder 70 is positioned between and in register with the plunger 26 and the magazine receiver 24. Referring to FIG. 13, by pushing the plunger 26 into the holder 70 (out of the page as viewed in FIG. 13) the ammunition in the first row of the holder 70 is plunged out of the first row and into the magazine M. With the front end of the plunger 26 inside the first row, the plunger temporarily prevents the carrier 22 from advancing forward along the interior of the main body 20. As shown by comparison of FIGS. 13 and 14, when the distal end of the plunger 26 is pulled out of the carrier 22, the carrier advances forward in the main body 20 until the next round of ammunition positioned in the first column engages the stop 84. As shown in FIG. 14, because there is a round of ammunition in the second row of the first column, movement of the carrier 22 is stopped such that the second row (the second slot 74) is in register with the plunger 26 and magazine receiver 24. Thrusting of the plunger 26 back into the carrier 22 pushes the second row of ammunition into the magazine M. Reciprocating movement of the plunger 26 in and out of the carrier 22 is repeated until the magazine M is full or the holder 70 has been emptied of ammunition. As shown in FIG. 15, after the last row of ammunition has been plunged into the magazine M and the distal end of the plunger 26 has been pulled out of the carrier, forward movement of the carrier 22 is stopped by the stop engagement surface 86 (see FIG. 4) of the rear wall of the holder 70 engaging the stop 84. In this position, the carrier 22 extends out of the open front end of the main body 20. The stop engagement surface 86 may be omitted without departing from the scope of the present invention. For example, in an alternative embodiment, the spring 32 may be connected at one of its ends to the interior of the main body 20 and at its other end to the carrier 22 such that when the spring extends beyond its relaxed position, tension of the spring (rather than the stop engagement surface 86) prevents the carrier from ejecting out the open front of the main body. To reset the loader 10 for loading another batch of ammunition, the user may push the carrier 22 rearward by pushing against the push member 102 to overcome the biasing force of the spring 32. When the carrier 22 is fully seated in the main body 20 (i.e., when the first row of the holder 70 is rearward from the stop 84), the distal end of the plunger 26 may be pushed back into the interior of the main body to position it between the front end of the carrier 22 and the stop 84 (see FIGS. 9 and 10). The cams 100A, 100B on the front of the carrier 22 assist in guiding the distal end of the plunger 26 in front of the carrier.

As is now apparent, the loader 10 may be used to load a magazine with ammunition by loading ammunition in the holder 70, mounting the magazine on the magazine receiver 24, and plunging row after row of ammunition into the magazine. The distal end of the plunger 26 may be repeatedly pulled out of and pushed back into the carrier. When the plunger 26 is pulled out of the carrier, the biasing force of the spring 32 on the carrier 22 and the engagement of the stop 84 with ammunition in the holder 70 causes the carrier 22 to automatically move to and stop in a position in which the next row holding ammunition is in register with the plunger 26 and magazine receiver 24. Ammunition is plunged from the slots 74 of the holder 70 into the magazine in a direction transverse to the direction of travel of the carrier 22.

Having described the invention in detail, it will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A firearm magazine loader for loading ammunition into a firearm magazine, the ammunition comprising at least one round of ammunition, the firearm magazine loader comprising:

a main body including a magazine receiver configured to receive the firearm magazine to be loaded with ammunition;

a carrier configured for carrying ammunition to be loaded into the firearm magazine, the carrier being sized and shaped to be supported by the main body for movement with respect to the main body, the carrier including a holder including multiple slots constructed to support the ammunition in a generally vertical orientation and define a vertical position of the ammunition in the holder with respect to the carrier, the holder including a front, a rear, a top, a bottom, and opposite sides, the slots extending between the opposite sides of the holder, each slot being sized for receiving more than one round of ammunition between the opposite sides of the holder, the holder being constructed for receiving ammunition into the slots from the top of the holder; and a plunger supported by the main body configured for plunging ammunition from the holder into the magazine receiver, the plunger being reciprocally movable with respect to the main body between retracted and plunged positions to thrust ammunition from the holder into the magazine receiver.

2. A firearm magazine loader as set forth in claim 1 wherein each slot includes at least one carrying surface constructed to at least partially underlie and engage ammunition in the slot for carrying the ammunition in the slot.

3. A firearm magazine loader as set forth in claim 2 wherein the at least one carrying surface includes a shoulder constructed to engage a shoulder of the round of ammunition in the slot.

4. A firearm magazine loader as set forth in claim 1 wherein the holder is constructed to carry the weight of the ammunition.

5. A firearm magazine loader as set forth in claim 1 wherein the slots have cross sections corresponding to the profile of at least a neck and a shoulder of the round of ammunition having a bullet end below a primer end in the holder.

6. A firearm magazine loader as set forth in claim 1 wherein the slots have cross sections corresponding to the profile of the round of ammunition having a bullet end below a primer end in the holder.

7. A firearm magazine loader as set forth in claim 1 wherein the top of the holder comprises a plurality of openings arranged in lines, each line being positioned in registration with a respective one of the slots.

8. A firearm magazine loader as set forth in claim 7 wherein the openings are sized for receiving individual rounds of ammunition.

9. A firearm magazine loader as set forth in claim 1 wherein each slot is constructed to support rounds of ammunition in the slot in alignment with one another along the slot.

10. An ammunition carrier for use with a firearm magazine loader for loading ammunition into a firearm magazine, the ammunition comprising at least one round of ammunition including a bullet end, a neck, a shoulder, a primer end, and a generally cylindrical body between the shoulder and primer end, the ammunition carrier comprising:

a holder for supporting ammunition to be loaded into the firearm magazine, the holder having a front, a rear, a top, a bottom, opposite sides, and at least one slot extending between the opposite sides, the holder being constructed for receiving ammunition into the at least one slot from the top of the holder, the at least one slot being sized for holding multiple rounds of ammunition in a row extending between the opposite sides and having opposite open ends on the opposite sides configured to permit ammunition supported in the at least one slot to be plunged out of one of the open ends, the at least one slot including a front wall and a rear wall defining the at least one slot therebetween, the front and rear walls including shoulders projecting into the at least one slot constructed to engage the shoulder of a round of ammunition.

11. An ammunition carrier as set forth in claim 10 wherein the at least one slot has a cross section corresponding to the profile of at least the neck and shoulder of the round of ammunition.

12. An ammunition carrier as set forth in claim 10 wherein the at least one slot has a cross section corresponding to the profile of at least the shoulder and generally cylindrical body of the round of ammunition.

13. An ammunition carrier as set forth in claim 10 wherein the top of the holder comprises a line of openings sized for receiving individual rounds of ammunition, the line being positioned in registration with the at least one slot.

14. An ammunition carrier as set forth in claim 10 wherein the at least one slot is constructed for supporting the ammunition in a generally vertical orientation.

15. An ammunition carrier as set forth in claim 10 wherein the at least one slot comprises a plurality of slots spaced between the front and rear of the holder.

16. An ammunition carrier as set forth in claim 15 further comprising a main body and a plunger, the main body including a magazine receiver configured to receive the firearm magazine to be loaded with ammunition, the holder being supported by the main body for movement with respect to the main body, and the plunger being supported by the main body and configured for plunging ammunition from the holder into the firearm magazine.

17. A firearm magazine loader for loading ammunition into a firearm magazine, the ammunition comprising at least one round of ammunition, the firearm magazine loader comprising:

a main body including a magazine receiver configured to receive the firearm magazine to be loaded with ammunition;

a carrier configured for supporting ammunition to be loaded into the firearm magazine, the carrier being sized and shaped to be supported by the main body for movement with respect to the main body, the carrier including a holder including a front, a rear, a top, a bottom, and opposite sides, the holder including multiple slots positioned between the front and rear of the holder each sized for receiving more than one round of ammunition, the slots extending between the opposite sides of the holder, the holder being constructed for receiving ammunition in the slots from the top of the holder; and a plunger supported by the main body configured for plunging ammunition from the holder into the magazine receiver, the plunger being reciprocally movable with respect to the main body along a plunging axis between retracted and plunged positions to thrust ammunition from the holder into the magazine receiver;

wherein the carrier has a loading position with respect to the main body in which the carrier is supported by the main body and positioned for loading ammunition into the multiple slots of the holder from the top of the holder, the front of the holder being positioned rearward from the plunging axis when the carrier is in the loading position.

18. A firearm magazine loader as set forth in claim 17 wherein the plunger is movable to the plunged position forward from the front of the holder when the carrier is in the loading position.

19. A firearm magazine loader as set forth in claim 18 further comprising a biasing member supported by the main body configured to bias the carrier for forward movement, and wherein when the carrier is in the loading position and the plunger is in the plunged position, the plunger maintains the carrier in the loading position against the bias of the biasing member.

20. A firearm magazine loader as set forth in claim 17 wherein the carrier includes a push surface in front of the holder sized to receive a finger of a user for pushing the carrier rearward against the bias of the biasing member, and wherein when the carrier is in the loading position the plunging axis is adjacent the push surface.

21. A firearm magazine loader as set forth in claim 17 further comprising a stop constructed to engage ammunition supported in the holder for indexing movement of the carrier with respect to the main body.

22. A firearm magazine loader as set forth in claim 21 wherein the holder includes partitions between adjacent slots, and the partitions include notches sized and arranged for permitting the partitions to pass the stop as the carrier moves forward.

* * * * *